US010858948B2

(12) United States Patent
Laroche

(10) Patent No.: US 10,858,948 B2
(45) Date of Patent: Dec. 8, 2020

(54) INTERSECTOR SEALING TAB FOR AN AIRCRAFT TURBINE ENGINE

(71) Applicant: Safran Aircraft Engines, Paris (FR)

(72) Inventor: Clément Raphaël Laroche, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 66 days.

(21) Appl. No.: 16/121,845

(22) Filed: Sep. 5, 2018

(65) Prior Publication Data

US 2019/0071990 A1 Mar. 7, 2019

(30) Foreign Application Priority Data

Sep. 6, 2017 (FR) ..... 17 58219

(51) Int. Cl.

| | |
|---|---|
| ***F01D 11/00*** | (2006.01) |
| ***F01D 9/06*** | (2006.01) |
| ***F01D 9/04*** | (2006.01) |
| ***F01D 9/02*** | (2006.01) |

(52) U.S. Cl.

CPC ..... *F01D 9/065* (2013.01); *F01D 9/02* (2013.01); *F01D 9/023* (2013.01); *F01D 9/04* (2013.01); *F01D 9/041* (2013.01); *F01D 11/005* (2013.01); *F05D 2240/11* (2013.01); *F05D 2250/70* (2013.01)

(58) Field of Classification Search

CPC ..... F01D 11/005; F01D 9/065; F01D 9/02; F01D 9/023; F01D 9/04; F01D 9/041

See application file for complete search history.

(56) References Cited

U.S. PATENT DOCUMENTS

| | | | | |
|---|---|---|---|---|
| 5,158,430 | A | 10/1992 | Dixon et al. | |
| 9,988,923 | B2 * | 6/2018 | Snyder | F01D 11/005 |
| 10,287,905 | B2 * | 5/2019 | Hill | F01D 11/001 |
| 2006/0082074 | A1 | 4/2006 | Synnott et al. | |

FOREIGN PATENT DOCUMENTS

| | | | |
|---|---|---|---|
| FR | 2 758 856 | A1 | 7/1998 |
| JP | 2014-080920 | A | 5/2014 |
| WO | WO-2015/031763 | A1 | 3/2015 |

* cited by examiner

*Primary Examiner* — J. Todd Newton
*Assistant Examiner* — Sabbir Hasan
(74) *Attorney, Agent, or Firm* — Blank Rome LLP

(57) ABSTRACT

The invention relates to a tab (5) for a sealing gasket device of a part of an aircraft gas turbine engine. The tab is arranged in respective slots of adjacent sectorized parts of the turbine engine nozzle. This tab has two bulging ends (51*a*, 51*b*) joined by a thinner intermediate part (51c) each having a connection with the other (53*a*, 53*b*), which can deform into a flat position by bracing the tab, when excess pressure is applied to its intermediate part from one side of the tab.

7 Claims, 3 Drawing Sheets

INTERSECTOR SEALING TAB FOR AN AIRCRAFT TURBINE ENGINE

CROSS-REFERENCE TO RELATED APPLICATIONS

This application claims the benefit of French Patent Application No. 1758219, filed on Sep. 6, 2017, the contents of which is incorporated herein by reference.

The present invention relates to the field of aircraft turbine engines and is aimed at a part of a turbine engine, particularly such as a nozzle of an axial turbine.

In the present text, axial refers to anything extending along or parallel to the longitudinal axis (X) of rotation of the part of the turbine engine concerned, the axis being in principle the main axis of rotation of the turbine engine. Anything radial (axis Z) and circumferential is that which extends radially to the X axis and around it, respectively. Moreover, any references to upstream and downstream are to be considered in relation with the flow of gases in the (part of the) turbine engine under consideration: these gases enter upstream and exit downstream, generally circulating parallel to the aforementioned longitudinal axis of rotation. And, a wall extending slantwise or perpendicularly to another so-called lateral wall will be transversal.

Turbine engine nozzles can be formed of a plurality of circumferentially successive blades whose bases or platforms together delimit a stream in which flows the air that supplies the downstream equipment in the turbine engine.

In the nozzle, the air flows at a determined pressure and it is necessary to prevent communication between the inside and the outside of the nozzle in order not to create any disturbances or pressure losses in the air flows. To achieve this, creating a circumferential sealing is known.

Generally, and thus in particular for nozzles, a part of an aircraft gas turbine engine extending along a circumferential direction around a longitudinal axis (X) of rotation and comprising the following is known from the prior art, such as FR 2 758 856:

- a first sectorized part (such as a first nozzle component),
- a second sectorized part (such as a second nozzle component), which is adjacent to the first sectorized part in the circumferential direction,
- and a sealing gasket device comprising tabs arranged in slots, or grooves, of both the first sectorized part and the second sectorized part and which are mutually arranged so as to face each other.

The term "part", in particular sectorized part, does not imply that it is a one-piece structure. Component and part are therefore synonymous.

In FR 2 758 856, the tabs used are each formed of a succession of flat strips (also called straight strips), arranged one over the other and narrower than the gap between the terminations (seat) of the slots in the extension, which allows them to slide one over the other according to the deformations or movements of the sectorized parts and of the turbine engine's vibrations and to spread into the slots. Admittedly, one advantage of this arrangement is that the flat strips thus occupy a larger overall width than that of each individual strips, which is intended to reduce bypass gas leaks. But, it is considered issues may remain despite this, in particular the following:

- difficulties when mounting due to the stacking of small parts,
- a lack of control of the tabs' position when the turbine engine is operating,

- occasional loss of tabs, leading to deteriorated performance and equipment to be replaced or repaired,
- leaks between tabs (in particular with so-called straight tabs, in particular at the point where they intersect with each other),
- even if the tabs are placed properly, leaks may occur outside the tabs due to defective sealing,
- wearing of the opposite parts has been observed on through-hole slots.

Therefore, what is proposed here is a solution to all or part of these issues, which provides that the tabs have two bulging ends joined by a thinner intermediate part, each of the two bulging ends of one said tab and the thinner intermediate part that joins them having a connection between them that is shaped so as to flatten itself in its respective slot, by bracing the tab and deforming said connection towards a flat position, when excess pressure is applied from one side of the tab on its intermediate part.

For the same purposes, it is proposed that one said tab has substantially flat lateral surfaces at the connections, so that it may flatten itself there in the slots.

To perfect the sealing, it is also proposed that the respective slots in which is arranged one said tab each have lateral walls that are substantially flat, at least opposite the aforementioned connections, to ensure a substantially plan against plan contact at these connections when said excess pressure is applied.

Surface bearing contacts, which guarantee efficient sealing, will thus be ensured.

In order to minimize the leaks mentioned, it is also proposed that at each slot end (into which one said bulging tab end is engaged), the slot concerned:

- has a reducing cross-section in the direction of the end,
- or has an open termination (open-seat) and thus is a through-hole slot.

Furthermore, to promote a limitation of the wear on opposite parts observed among others on through-hole slots, it is also proposed that at the ends of the tab, said bulging ends and the walls opposite the slots fit together through contacts that are substantially cylinders to plans, without sharp edges.

The invention also relates to a sealing method implemented between a sealing gasket device and first and second sectorized parts, which are adjacent one to another, a method in which:

- a said sealing gasket device comprising tabs having two bulging ends joined by a thinner intermediate part is provided,
- a said tab is arranged in slots of both the first and second sectorized parts and which are mutually arranged so as to face each other, with the two bulging ends at the termination of the respective slots, characterized in that when an excess pressure is applied from one side of the tab to its intermediate part, a said tab in two said slots into which it is engaged is allowed to:

- come into abutment by its two respective bulging ends with transversal walls of the first and second sectorized parts, at the termination of the respective slots, and
- deform into a flat position at the connections between the two respective bulging ends and the thinner intermediate part that joins them, until it flattens itself, at these connections, against respective lateral walls of the first and second sectorized parts, in the respective slots.

When an excess pressure is applied from one side of the tab and the two bulging ends of said tab are in cylinder-to-plan contact in the slots, the excess pressure then creates a moment, at each bulging end, the excess pressure creates a moment around an axis that is transversal to the longitudinal axis of the tab. Opposite the side having been subjected to an excess pressure, this moment will flatten the lateral surface of the tab including said "connections" against a lateral wall of the slots.

The invention further relates to one said tab of a sealing gasket device of a turbine engine part as mentioned above, with all or part of its characteristics and in which the tab is intended to be arranged in respective slots of adjacent sectorized parts of the turbine engine, the tab having two bulging ends joined by a thinner intermediate part, characterized in that each of the two bulging ends and the thinner intermediate part that joins them have a connection between them, which can deform into a flat position by bracing the tab, when excess pressure is applied to its intermediate part from one side of the tab.

To perfect the sealing, it has already been noted that it may be favourable for the tab under consideration to have substantially flat lateral surfaces at said connections so that it may flatten itself at these connections in the slots concerned, so as to rest plan against plan (when said excess pressure is applied on one side of the tab).

If necessary, the invention will be better understood and other characteristics, details and advantages thereof will become apparent upon reading the following description as a non-exhaustive example with reference to the appended drawings in which.

Figure 7:
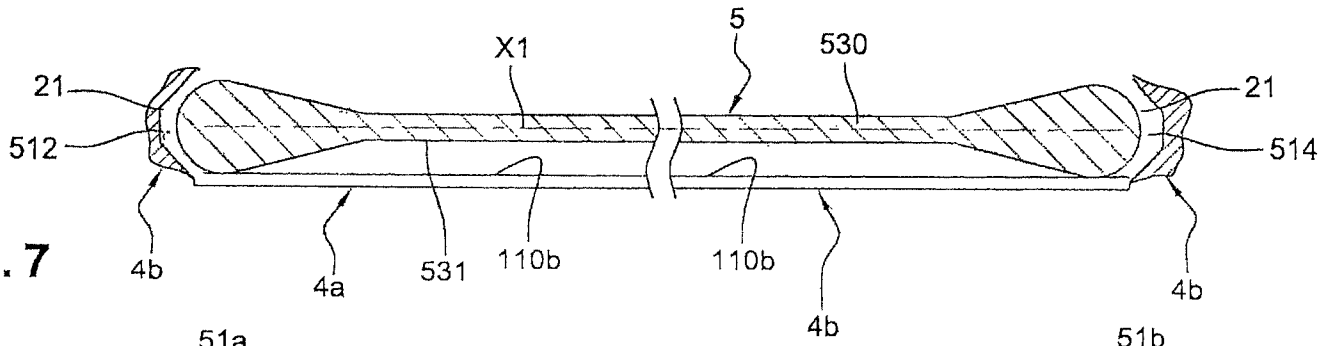
Figure 8:
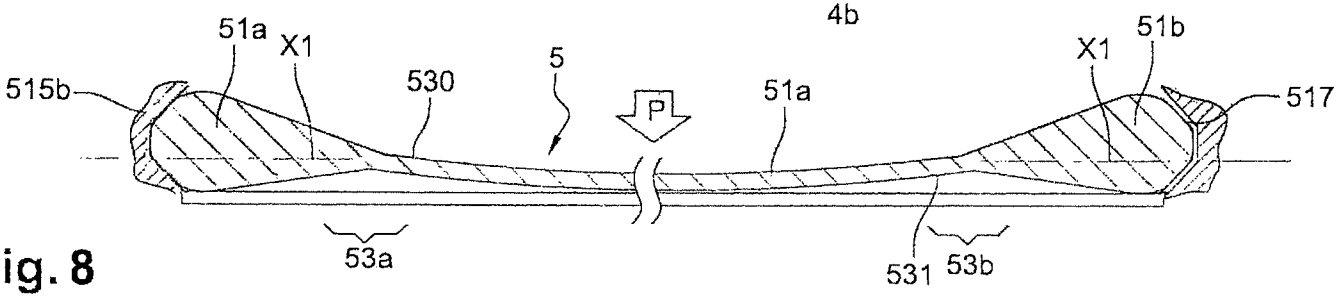
Figure 9:
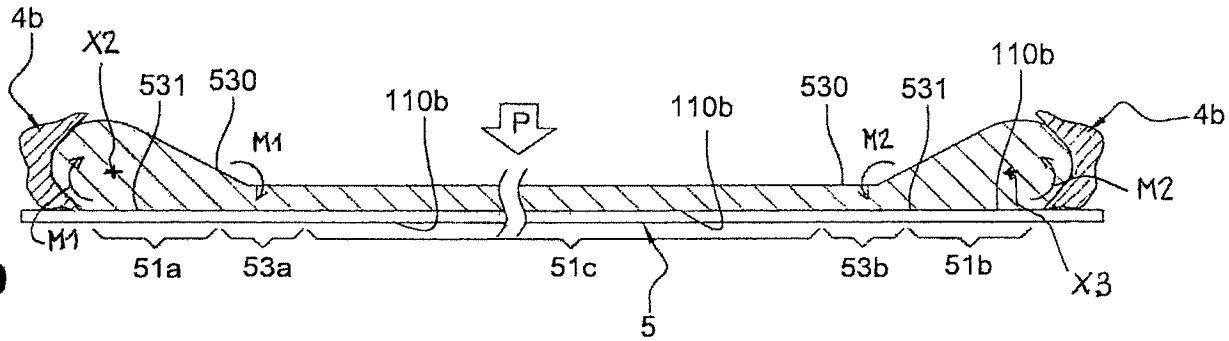

And FIGS. 7, 8, 9 show, according to the invention, three states of a mounted tab, according to a view that is parallel to the axes X, X1.

Conventionally, an aircraft gas turbine engine includes, from upstream to downstream, along a longitudinal axis (X axis in FIG. 1): a fan, a low-pressure compressor, a high-pressure compressor, a combustion chamber, a high-pressure turbine and a low-pressure turbine. The low-pressure turbine may include several mobile stages on the same rotor and thus drive, by means of a central shaft, the assembly formed by the fan and the low-pressure turbine.

Figure 1:
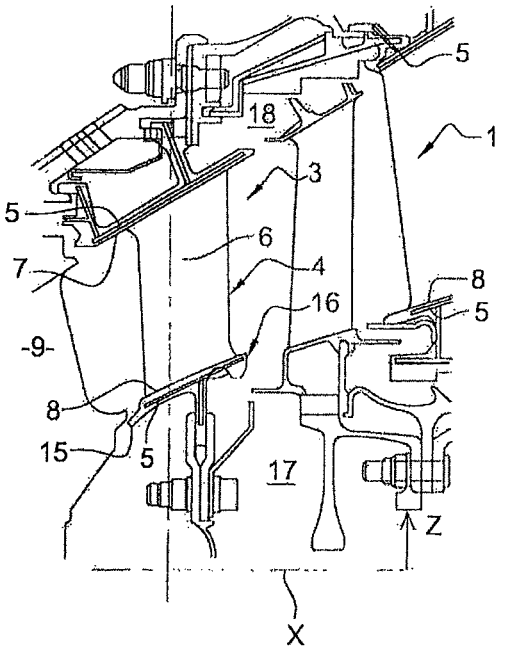
FIG. 1 is a cross-section parallel to the X axis of a part of an aircraft gas turbine engine comprising several nozzle rings.

In FIG. 1, one part 1 of one such turbine engine comprising a nozzle 3 (stator), circumferentially sectorized around the X axis, having a plurality of blades 4 circumferentially arranged end to end and sealing pads or tabs 5 capable of being arranged between two adjacent blades 4 (referred to 4*a*, 4*b*, FIG. 3 or 5 among others), or groups of such circumferentially successive blades.

Figure 2:
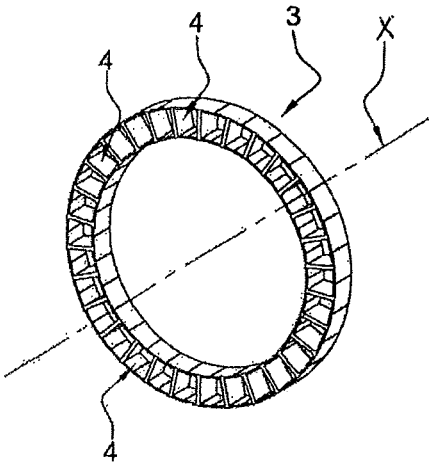
FIG. 2 is a schematic view showing such a nozzle ring around its axis of revolution; the X axis.

FIG. 2 schematically shows the nozzle 3 around its X axis of revolution.

Figure 3:
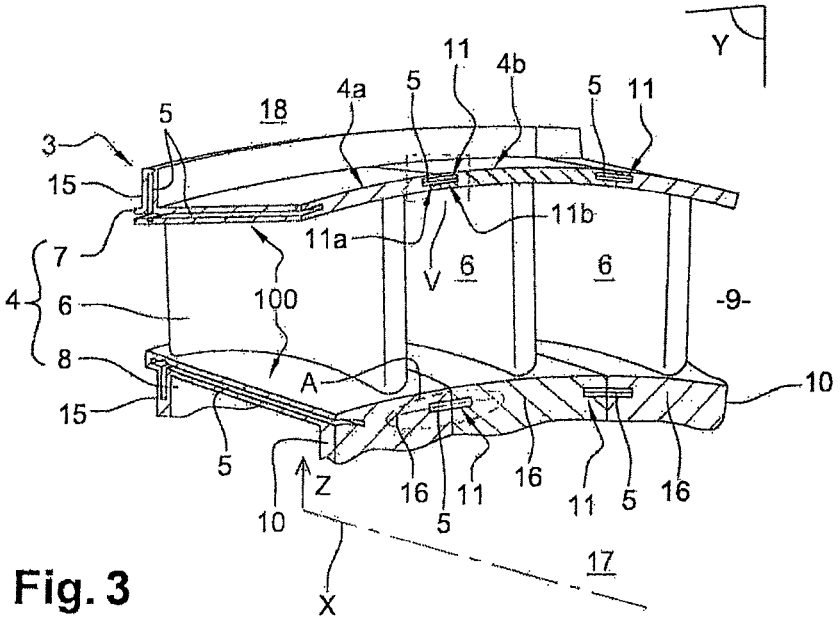
FIG. 3 is a schematic view showing the circumferential abutment of several blades together forming a nozzle ring, in the circumferential section plane Y perpendicular to the X axis.

As can be seen in FIG. 3, each blade 4 includes a substantially radial vane 6 extending between a radially outer platform 7 and a radially inner platform 8, respectively forming the two limits between which is defined a gas flow stream 9. Each sector, or sectorized part, of the nozzle thus formed may include one or several blades 4 circumferentially joined into a single part.

Each platform 7, 8 of a blade 4 has two end faces 10 parallel to the X axis each comprising at least one slot 11 (or 11*a*, 11*b*. FIG. 3 and following). As can be seen, for example, in FIG. 5 for slot 11*b*, each slot is limited in the circumferential plane Y by a radially inner lateral wall, such as 110*b*, a radially outer lateral wall, such as 111*b*, and a single transversal wall, such as the termination wall 14*a* (slot 11*a*) or 14*b* (slot 11*b*) in FIG. 5. A slot 11 can thus lead to a transversal face 10; plane X-Z. A slot 11 can also be through-hole or blind on an upstream face 15 and/or a downstream face 16 of the platform 7 or the platform 8, as illustrated in FIG. 3.

When the blades 4 are circumferentially abutted, as in FIGS. 2, 3, a face 10 of a first blade 4 is opposite a face 10 of a circumferentially adjacent blade 4. Two consecutive adjacent slots 11 of said faces 10 are then opposite each other. Two successive blades thus define an example of said first and second sectorized parts.

Figure 5:
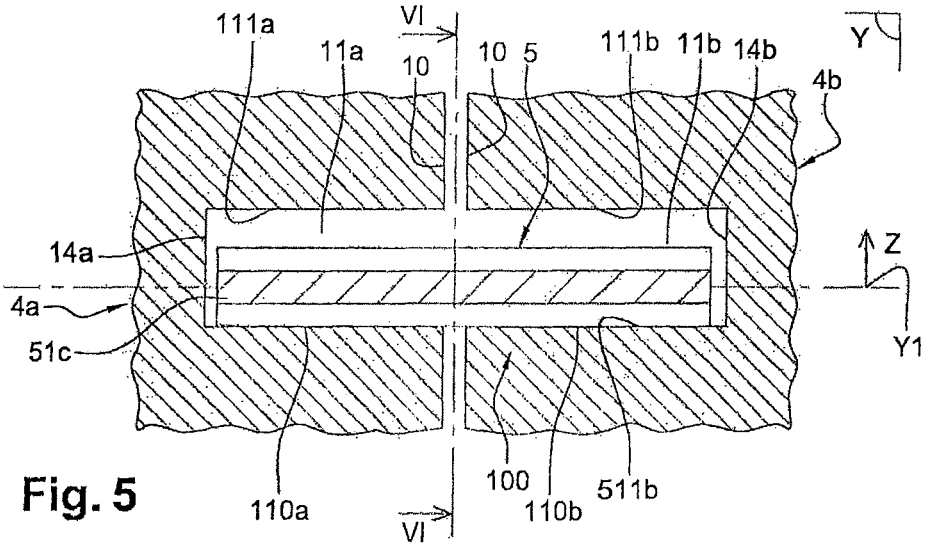
FIG. 5 is a cross-section like FIG. 3 showing a solution according to the invention, along the enlarged detail V.

The tabs 5 are individually arranged in two such opposite slots, thus such as 11*a*, 11*b*, in FIG. 5 and following for the considered tab, in order to achieve at the platforms 7 and 8 the sealing of the air stream 9 with respect to a first inner area 17 of the ring formed by the inner platforms 8 and a second outer area 18 in relation to the ring formed by the outer platforms 7; see FIGS. 1, 3.

As a component of such a sealing gasket device 100, each tab 5 arranged in the slots 11 (or 11*a*, 11*b*) has two bulging ends, 51*a*, 51*b* respectively, joined by a thinner intermediate part 51*c*.

Figure 4:
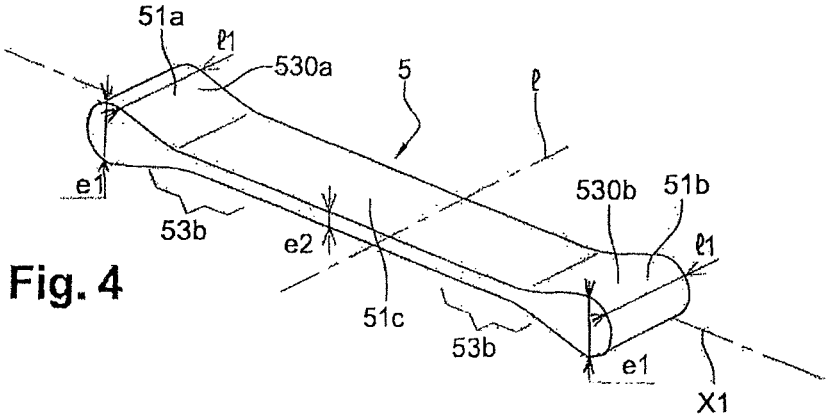
FIG. 4 is a perspective view of a sealing tab according to the invention.

In the examples, the tabs 5 consist of a single part, i.e. they are one-piece as can be seen in particular in FIG. 4. In the slots 11*a*, 11*b*, they each extend along an elongation axis parallel to the X axis (e.g. axis X1, FIG. 4 or 6).

To address at least part of the problems mentioned above in the description, the two bulging ends 51*a*, 51*b* of one said tab and the thinner intermediate part 51*c* have connections between each other respectively 53*a*, 53*b* which, by bracing this tab 5 (see FIG. 8 then 9) from an unstressed state (see FIGS. 4 to 7), will be able to deform into a flat position (FIG. 9), when an excess pressure P is applied from one side of the tab, in particular on its intermediate part 51*c*.

In FIGS. 4, 8, it can be clearly seen that the tab 5 concerned here has substantially flat lateral surfaces 530, 531 to, in particular at the connections 53*a*, 53*b* and on the side opposite to the one on which the (excess) pressure will be applied, to flatten itself at these connections in the slots, so as to rest plan against plan, in order to achieve the expected sealing.

Complemented by FIGS. 3 to 6, FIGS. 7 to 9 show, in relation with the invention, a procedure to seal the space between the stream 9 and at least one of the areas 17, 18.

First, as described above and illustrated in particular in FIG. 4, a series of sealing tabs 5 will be used that will be individually arranged in their receiving slots 11 or 11*a*, 11*b* which are adjacent two by two, both to the first and second sectorized parts 4 or 4*a*, 4*b*.

Figure 6:
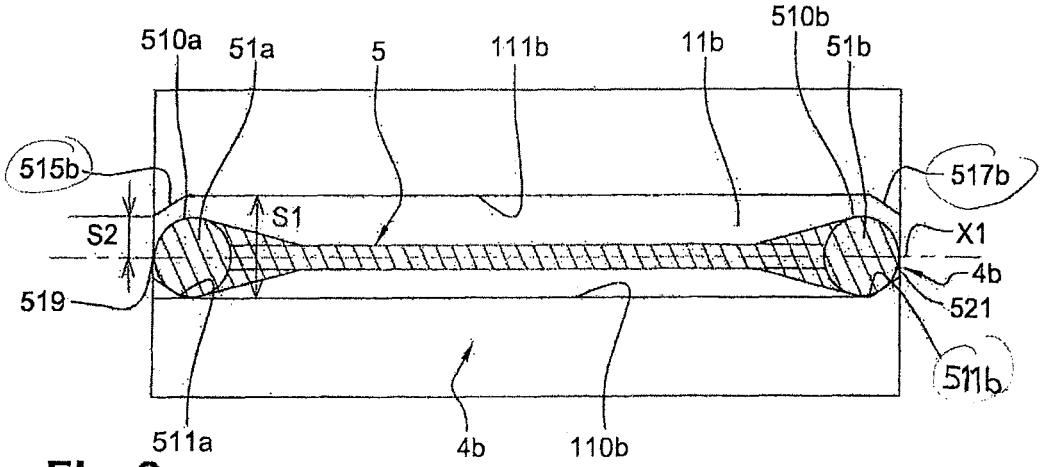
FIG. 6 is a cross-section along the line VI-VI in FIG. 5 showing a complete tab and slot.

The two bulging ends 51*a*, 51*b* of each said tab 5 are thus in place toward the termination concerned of the respective slots. While the turbine engine 1 is not running, thus cold, each tab 5 in place is then, by gravity and in its unstressed state, resting against one of the respective radially inner and radially outer lateral walls 110*a*, 110*b*, 111*a*, 111*b* of each slot, as shown in FIG. 6 or 7, via the radially inner or radially outer bearing surfaces, 530, 531 respectively, this at its bulging ends 51*a*, 51*b*: bearing areas 510*a*, 510*b*, 511*a*,

511*b*. In the slots 11*a*, 11*b*, the thinner intermediate parts 51*c* are then, however, each moved away from said faces 110*a*, 110*b* and 111*a*, 111*b*.

Opposite the axial edges, ends or terminations 512, 514 of said slots, each tab 5 in addition favourably has a mounting clearance 21 at this time (FIG. 7; axis X1).

FIG. 8 schematically shows a transitional stage: in the environment concerned of the turbine engine which is then running, the pressure has reduced, and the temperature has risen. And above all, for what we are concerned with, a (excess) pressure P is then exerted from one side on each tab 5 which, in the slots 11*a*, 11*b*, starts to bend, thus deforming elastically, under stress (by expansion), in the direction of its elongation: axis X1. Substantially following this axis, the bulging ends 51*a*, 51*b* of the tab concerned then enter into abutment at the termination of the slots against the upstream and downstream transversal walls, such as the respective walls 515*b*, 517*b*, of a slot 11*b*, FIG. 6 or 7. There are no longer any clearance 21.

The absence of clearance 21 prevents any axial movement of the tab 5, which is abutted at its bulging ends 51*a*, 51*b* (at the bearing areas 510*a*, 510*b*, 511*a*, 511*b*) with the transversal walls 515*b*, 517*b* of the slot 11*b*. When an excess pressure P is applied from one side of the tab 5, in particular on its intermediate part 51*c*, the tab is forced to deform by arching. The excess pressure creates a moment at each of the bulging ends 51*a*, 51*b* (moments M1 and M2 in FIG. 9), these bulging ends 51*a*, 51*b* respectively only having a single degree of liberty, i.e. a rotation:

around an axis that is transversal to X1, (axes X2 and X3, in FIG. 9), and in the direction of the excess pressure P.

The moments M1, M2 lead the connections 53*a*, 53*b* to rest against the lateral wall 110*b*, 111*b* opposite the excess pressure P. This bearing of the connections 53*a*, 53*b* results in the flat surface 530, 531, and more specifically the intermediate part 51*c* of the tab 5, being put into contact with the lateral wall 110*b*, 111*b* of the slot 11*b* opposite the excess pressure P.

In a preferred embodiment, the transversal walls 515*b*, 517*b* and the axial terminations 512, 514 of the slot 11*b* are shaped so as to fit the contour of the bulging ends 51*a*, 51*b*, and more specifically and more specifically the contour of the bearing areas 510*a*, 510*b*, 511*a*, 511*b*. The shape cooperation between the bulging ends 51*a*, 51*b* and both the transversal walls 515*b*, 517*b* and axial terminations 512, 514 of the slot 11*b* promotes the creation of the aforementioned moments in the event of excess pressure P.

The above for slot 11*b* applies in the same manner to slot 11*a*.

FIG. 9 schematically shows a hot situation (temperature greater than 300° C.). The turbine engine is operating. It is, for example, at a steady cruising speed. The temperature tends towards a maximum and especially the pressure P exerted from one side on each tab is sufficiently high for the considered tab 5 not to be able to extend along X1. A mechanical moment is created in the tab (see arrows in FIG. 9), flattening the lateral surfaces, in this case inner 531, of the tabs against the respective faces, in this case thus inner 110*a*, 110*b*, of the opposite slots concerned. The bulging ends 51*a*, 51*b* are still abutted at the end, or termination, against the upstream and downstream transversal walls of said slots, such as the walls 515*b*, 517*b* for a slot 11*b*.

The lateral walls, located on one same (radially outer or inner) side, of the adjacent slots will be favourably coplanar.

And, in a more general manner, these outer or inner lateral walls (110*a*, 110*b*, 111*a*, 111*b*) of the slots will be favourably substantially planar, respectively, and this over their entire extension, opposite the tabs.

As can be seen in FIG. 9, the considered tab 5 thus deformed toward a flat position at the location of its two connections 53*a*, 53*b*, until it flattens itself at these connections against the aforementioned respective lateral walls (inner in the example) of the two sectorized parts concerned, here 4*a*, 4*b*.

Both in an unstressed state and once the tab is sealingly flattened after deforming, the intermediate part 51*c* of each tab can typically be rectilinear, so that, with the tab flattened and up to the two bulging ends 51*a*, 51*b*, the inner or outer lateral surface concerned 530, 531, is substantially flat, thus sealingly flattened in the slots, against an equally flat respective said lateral wall of these slots.

A support, which can be effective from end to end, of each tab 5 in the slots, such as 11*a*, 11*b*, is then achieved. FIG. 9 clearly shows this coplanar support, plan against plan.

Theoretically, there is no more radial leakage between two sectorized parts over the entire length of the sector's axial extension.

Concerning axial leaks, with such a flat tab technology with each end 51*a*, 51*b* being water drop shaped in the radial cross section, as in the embodiment that is preferred here, and even more so with through-hole slot terminations as in FIG. 6, the load in pressure of these slots will be great, guaranteeing optimized sealing.

To promote the flattening of the tab in the slots, the ends 51*a*, 51*b* have a thickness that gradually increases radially starting from the intermediate part 51*c* toward the end of the tab 5 and then decreases slightly between a point, located next to the end of the tab, where the thickness of the tab 5 is greatest (e1 in FIG. 4) and the end of the tab 5. More specifically, the maximum thickness e1 of each end 51*a*, 51*b* can vary between 50% and 300% of the thickness e2 of the intermediate part 51*c*. As to the width dimension (I1) of each end 51*a*, 51*b* along the direction of the width I of the tab 5 (FIG. 4 and FIG. 5, direction Y1), it will favourably range between 1 and 5 times the maximum thickness e1. It should be considered here that the length of the tab 5 is along X1, its width I is tangential to the circumference (direction Y1, FIG. 5), and the thickness (e1 or e2) is along the axis Z.

In this regard, in order for, under the pressure P, a tab to stall and brace in a well-guided manner at the axial ends, it is provided that opposite the transversal walls, such as 515*b*, 517*b*, of slot ends into which one so-called tab bulging end 51*a*, 51*b* thus is engaged, the slot concerned has a reducing cross-section in direction of the end: see the cross-sections S1 and S2 that are transversal to the direction X1 in FIG. 6, where S2<S1, S1 being the nominal transversal (or radial) cross-section of each slot, except in this case at the termination of a slot where it will thus reduce to S2.

Such a slot termination shape will indeed prevent the tab from exiting and transmit the stresses, once the tab is resting, Such a beveled or more rounded area will additionally promote the bracing/deforming/flattening movement of the connecting areas to be flattened, of the tab whose bulging ends 51*a*, 51*b* will be able to have a substantially cylindrical base and connected by slanted faces to the intermediate part 51*c*, as shown schematically in FIG. 6. In this regard, it should be noted that cylinder/plan contacts, without sharp edges, thus as shown schematically, between the extremities of bulging tab ends and the walls opposite the slots will help to limit the wear of opposite parts observed on through-hole slots.

As an alternative or complement, whatever the case may be, this does not prevent that at each slot end 512, 514 the concerned slot can have an open termination (transversal wall), also as shown in 519, 521, in FIG. 6.

It should be noted again that the presence of an open termination does not alter the creation of a moment M1 or M2 in the event of a said excess pressure P. Thus in FIG. 6, the bulging ends 51*a*, 51*b* of the tab are axially and radially abutted against the transversal walls of the slots 11*a*, 11*b*. These abutments imply that in the event of excess pressure P, the creation of the M1 and M2 moments that flatten, as previously, the connections 53*a*, 53*b*, the flat surface 530, 531, and more specifically the intermediate part 51*c*, against the lateral wall (opposite the excess pressure) of the slots 11*a*, 11*b*.

The invention claimed is:

1. A part of an aircraft gas turbine engine extending along a circumferential direction around a longitudinal axis of rotation and comprising:

a first sectorized part;

a second sectorized part that is adjacent to the first sectorized part in the circumferential direction; and a sealing gasket device comprising tabs arranged in slots of both the first and second sectorized parts and which are mutually arranged so as to face each other, wherein:

a tab of the tabs has a first bulging end, a second bulging end, and a thinner intermediate part, a thickness of the tab at the first bulging end and a thickness of the tab at the second bulging end are greater than a thickness of the tab at the thinner intermediate part, the first bulging end is joined to the thinner intermediate part by a first connection, the second bulging end is joined to the thinner intermediate part by a second connection, the first bulging end of the tab is engaged in a first slot of the slots, the second bulging end of the tab is engaged in a second slot of the slots, the first connection is configured to deform and flatten, on a second side of the tab, against the first slot by bracing the tab in response to pressure applied to the thinner intermediate part from a first side of the tab opposite the second side, and the second connection is configured to deform and flatten, on the second side of the tab, against the second slot by bracing the tab in response to the pressure applied to the thinner intermediate part from the first side of the tab opposite the second side.

2. The turbine engine part according to claim 1, wherein the first slot has a lateral wall that is flat opposite said first connection to ensure a planar contact at these connections when said pressure is applied.

3. The turbine engine part according to claim 1, wherein, the first slot has a through-hole termination.

4. A sealing method implemented between a sealing gasket device and first and second sectorized parts, which are adjacent one to another, of an aircraft gas turbine engine nozzle, a method in which:

a said sealing gasket device comprising tabs is provided, a first bulging end of a tab of the tabs is arranged in a first slot of the first sectorized part and a second bulging end of the tab is arranged in a second slot of the second sectorized wherein the first and second slot are mutually arranged so as to face each other, and wherein:

a thickness of the tab at the first bulging end and a thickness of the tab at the second bulging end are greater than a thickness of the tab at a thinner intermediate part, the first bulging end is joined to the thinner intermediate part by a first connection, the second bulging end is joined to the thinner intermediate part by a second connection, and, in response to pressure applied the thinner intermediate part from a first side of the tab:

the first connection is configured to deform and flatten, on a second side of the tab opposite the first side, against the first slot by bracing the tab, and the second connection is configured to deform and flatten, on the second side of the tab, against the second slot by bracing the tab.

5. A tab of a sealing gasket device of a turbine engine part, the tab configured to be arranged in respective slots of adjacent sectorized parts of a turbine engine nozzle, the tab including a first bulging end;

a second bulging end; and a thinner intermediate part, wherein a thickness of the tab at the first bulging end and a thickness of the tab at the second bulging end are greater than a thickness of the tab at the thinner intermediate part, wherein the first bulging end is joined to the thinner intermediate part by a first connection, wherein the second bulging end is joined to the thinner intermediate part by a second connection, wherein the first bulging end is configured to engage a first slot of the slots and the second bulging end is configured to engage a second slot of the slots, wherein the first connection is configured to deform and flatten, on a second side of the tab, by bracing the tab, in response to pressure applied to the thinner intermediate part from a first side of the tab opposite the second side, and wherein the second connection is configured to deform and flatten, on the second side of the tab, against the second slot by bracing the tab in response to the pressure applied to the thinner intermediate part from the first side of the tab opposite the second side.

6. The tab according to claim 5, wherein the first bulging end has a maximum thickness ranging from 50% to 300% of the thickness of the thinner intermediate part.

7. The tab according to claim 5, wherein the first bulging end has a maximum thickness and, transversally to the maximum thickness, a width ranging from 1 to 3 times said maximum thickness.

* * * * *